US008540449B2

(12) United States Patent
Song

(10) Patent No.: US 8,540,449 B2
(45) Date of Patent: Sep. 24, 2013

(54) FLUID-MATERIAL SPREAD APPARATUS HAVING DOUBLE ROLLER

(75) Inventor: Ho Suk Song, Incheon (KR)

(73) Assignee: S & P World Ltd., Incheon (KR)

( * ) Notice: Subject to any disclaimer, the term of this patent is extended or adjusted under 35 U.S.C. 154(b) by 388 days.

(21) Appl. No.: 13/018,525

(22) Filed: Feb. 1, 2011

(65) Prior Publication Data

US 2011/0250006 A1 Oct. 13, 2011

(30) Foreign Application Priority Data

Mar. 12, 2010 (KR) ..... 10-2010-0022527
Jun. 1, 2010 (KR) ..... 10-2010-0051739

(51) Int. Cl.
*B43M 11/02* (2006.01)
*B43M 11/06* (2006.01)

(52) U.S. Cl.
USPC ..... 401/218; 401/21; 401/183; 401/220

(58) Field of Classification Search
USPC ..... 401/21, 183–186, 218–220
See application file for complete search history.

(56) References Cited

U.S. PATENT DOCUMENTS

| | | | | | |
|---|---|---|---|---|---|
| 642,367 | A * | 1/1900 | Ray et al. | ..... | 101/329 |
| 1,909,326 | A * | 5/1933 | Wheeler, Jr. | ..... | 101/329 |
| 2,932,045 | A * | 4/1960 | Rabelow | ..... | 401/186 |
| 3,069,718 | A * | 12/1962 | Brady et al. | ..... | 401/220 |
| 3,075,230 | A * | 1/1963 | Marchant | ..... | 401/220 |
| 4,270,526 | A * | 6/1981 | Morales et al. | ..... | 601/154 |
| 4,817,526 | A * | 4/1989 | Winston | ..... | 101/329 |
| 5,201,279 | A * | 4/1993 | Impastato et al. | ..... | 119/51.03 |
| 5,615,444 | A * | 4/1997 | Reye | ..... | 15/230.11 |
| 5,836,320 | A * | 11/1998 | Gueret | ..... | 132/317 |
| 5,845,659 | A * | 12/1998 | Hutchins | ..... | 132/317 |
| 5,857,795 | A * | 1/1999 | Liou | ..... | 401/218 |
| 6,017,162 | A * | 1/2000 | Call | ..... | 401/6 |
| 6,053,650 | A * | 4/2000 | Bennett et al. | ..... | 401/208 |
| 6,190,077 | B1 * | 2/2001 | Newson et al. | ..... | 401/192 |
| 6,378,426 | B1 * | 4/2002 | Furr et al. | ..... | 101/329 |
| 6,386,782 | B1 * | 5/2002 | White, Sr. | ..... | 401/220 |
| 6,394,681 | B1 * | 5/2002 | Moore | ..... | 401/218 |
| 6,729,788 | B2 * | 5/2004 | Bouveresse | ..... | 401/220 |
| 7,338,217 | B2 * | 3/2008 | Morimoto et al. | ..... | 385/88 |
| 7,644,589 | B2 * | 1/2010 | Habatjou | ..... | 62/60 |
| 2010/0239356 | A1 * | 9/2010 | Caulier | ..... | 401/157 |
| 2012/0045270 | A1 * | 2/2012 | Apodaca et al. | ..... | 401/185 |

* cited by examiner

*Primary Examiner* — David Walczak
*Assistant Examiner* — Jennifer C Chiang
(74) *Attorney, Agent, or Firm* — Lexyoume IP Meister, PLLC.

(57) ABSTRACT

An apparatus for liquid material application with a dual roller structure includes a body having a space for holding contents therein, with a first discharge port being formed on an upper portion of the body to discharge the contents; a roller support mounted on an upper portion of the body, and having, on a lower surface thereof, a second discharge port which communicates with the first discharge port; a first roller unit rotatably mounted on a lower portion of the roller support, and making contact with the contents which are discharged from the second discharge port; and a second roller unit rotatably mounted on an upper portion of the roller support in such a way as to be put in contact with the first roller unit to discharge the contents that are discharged from the first roller unit.

30 Claims, 14 Drawing Sheets

FLUID-MATERIAL SPREAD APPARATUS HAVING DOUBLE ROLLER

BACKGROUND OF THE INVENTION

1. Field of the Invention

The present invention relates generally to a container which is capable of applying liquid material. More particularly, the present invention relates to a container which uses a dual roller structure to enable liquid material to be evenly applied.

2. Description of the Related Art

Conventional liquid material is applied to a desired location using the hand or a brush, after being discharged from a container containing the liquid material. For example, as for a liquid cosmetic container, a user discharges liquid cosmetic material from the cosmetic container to the palm of one hand or the like, and then applies the liquid cosmetic material to the desired skin portion using the fingers of the other hand or a brush.

During the operation of applying the liquid material, the liquid material may adhere to undesired places, for example, the hands or the clothing. Hence, the liquid material may cause contamination or the liquid material may be wasted.

In order to solve the problem, there has been proposed a structure wherein one roller for applying liquid material is mounted to a liquid container. However, in the case of applying the liquid material using only one roller, an excessively large or small amount of liquid material may adhere to the roller, so that it is impossible to uniformly apply the contents to the roller. Further, when an excessively large amount of liquid material adheres to the roller, the roller swells up, so that the roller is not easy to rotate.

SUMMARY OF THE INVENTION

Accordingly, the present invention has been made keeping in mind the above problems occurring in the prior art, and an object of the present invention is to provide a liquid-material application apparatus with a dual roller structure, which is intended to prevent liquid material from adhering to an undesired portion, when the liquid material is applied to a desired location such as the user's skin.

Another object of the present invention is to provide a liquid-material application apparatus with a dual roller structure, which allows liquid material to be evenly applied to a roller.

A further object of the present invention is to provide a liquid-material application apparatus with a dual roller structure, which enables the discharge of liquid material to be easily controlled by rotating a container to the left or right.

In order to accomplish the above objects, the present invention provides a liquid-material application apparatus with a dual roller structure, including a body having a space for holding contents therein, with a first discharge port being formed on an upper portion of the body to discharge the contents.

The apparatus includes a roller support placed on an upper portion of the body and having on a lower surface thereof a second discharge port which communicates with the first discharge port.

The apparatus includes a first roller unit rotatably placed above the lower surface of the roller support and making contact with the contents which are discharged from the second discharge port, and a second roller unit placed on a side of the first roller unit in such a way as to be put in contact with the first roller unit and rotatably coupled to the roller support.

When the second roller unit rotates, the first roller unit rotates while being in contact with the second roller unit, thus transferring the contents from the second discharge port to the second roller unit.

A concave part may be formed above the lower surface of the roller support to receive the first roller unit therein.

The second discharge port may be formed on the concave part to communicate therewith.

A step may be provided on an edge of the concave part, so that the first roller unit is seated at opposite ends thereof on the step, thus spacing a bottom surface of the concave part and the first roller unit apart from each other.

A rotating shaft may be provided on each of opposite ends of the first roller unit, and a shaft insert groove may be provided on the edge of the concave part so that the rotating shaft is seated therein.

The shaft insert groove may be formed to space the bottom surface of the concave part and the first roller unit apart from each other when the rotating shaft of the first roller unit is seated in the shaft insert groove.

A depressed portion may be formed in the concave part to hold contents discharged from the second discharge port, and the second discharge port may be formed to communicate with the depressed portion.

A coupling projection may project upwards from the upper portion of the body, and the first discharge port may be formed an upper portion of the coupling projection.

An extension part may be coupled to the coupling projection, and may include a through hole communicating with the first discharge port.

A check valve may be provided in the through hole of the body.

The extension part may have a cylindrical shape, and the roller support may have on the lower surface thereof a coupling piece which is rotatably coupled to the extension part.

A projection for opening or closing the through hole may be provided on the lower surface of the roller support in such a way as to extend downwards, so that the projection opens or closes the through hole when the roller support moves up or down.

Thread grooves may be formed on an outer circumference of the extension part, and threads may be formed on the coupling piece to be inserted into the thread grooves, whereby, if the roller support moves up according to a direction in which the roller support having the coupling piece rotates, the projection moves up, thus opening the outlet, and if the roller support moves down, the projection moves down, thus closing the outlet.

A nozzle having an outlet may be provided in the through hole, and a projection for opening or closing the outlet may be provided on the lower surface of the roller support in such a way as to extend downwards, so that the projection opens or closes the outlet when the roller support moves up or down.

Thread grooves may be formed on an outer circumference of the nozzle, and threads may be formed on the coupling piece to be inserted into the thread grooves, whereby, if the roller support moves up according to a direction in which the roller support having the coupling piece rotates, the projection moves up, thus opening the outlet, and if the roller support moves down, the projection moves down, thus closing the outlet.

A guide piece may protrude from an upper portion of the extension part, and a contact piece may be provided on the lower surface of the roller support to make contact with the guide piece, whereby, when the roller support rotates, so that the guide piece comes into contact with the contact piece, the projection is positioned so as to open the through hole or outlet.

The extension part may include on a side surface thereof a protrusion having a seating groove, and the roller support may include on the lower surface thereof a protruding piece which is inserted into the seating groove when the roller support rotates, so that the protruding piece is seated into the seating groove when the through hole or outlet is opened or closed.

A plurality of grooves may be formed on an outer surface of the first roller unit.

The grooves may be continuously formed in a direction perpendicular to a direction of rotation of the first roller unit or in the same direction as the direction of rotation thereof.

The grooves may be discontinuously formed in a direction perpendicular to a direction of rotation of the first roller unit or in the same direction as the direction of rotation thereof.

The grooves may be continuously or discontinuously formed in a direction inclined relative to a direction of rotation of the first roller unit.

The grooves may cross each other.

A plurality of protrusions may be formed on the first roller unit.

The first roller unit may include a plurality of balls.

At least one of the first and second roller units may comprise a plurality of rollers.

When the first roller unit comprises one roller and the second roller unit comprises two rollers, the roller of the first roller unit may be placed between first and second rollers of the second roller unit in such a way as to be in contact therewith, and the first and second rollers of the second roller unit may be spaced apart from each other.

When the first roller unit comprises two rollers and the second roller unit comprises one roller, first and second rollers of the first roller unit may be in contact with the roller of the second roller unit, and the first and second rollers of the first roller unit may be spaced apart from each other.

When the first roller unit comprises two rollers and the second roller unit comprises two rollers, a first roller of the first roller unit may be in contact with a first roller of the second roller unit, and a second roller of the first roller unit may be in contact with a second roller of the second roller unit, the first and second rollers of the first roller unit being spaced apart from each other, and the first and second rollers of the second roller unit being spaced apart from each other.

When the first roller unit comprises three rollers and the second roller unit comprises one roller, a central roller of the first roller unit may have on opposite sides thereof two peripheral rollers which are spaced apart from the roller of the second roller unit and are in contact with the central roller.

When the first roller unit comprises three rollers and the second roller unit comprises one roller, a central roller of the first roller unit may have on opposite sides thereof two peripheral rollers which are in contact with the central roller, and the roller of the second roller unit may be in contact with the peripheral rollers of the first roller unit, and the central roller of the first roller unit and the roller of the second roller unit may be spaced apart from each other.

When the first roller unit comprises three rollers and the second roller unit comprises two rollers, a central roller of the first roller unit may have on opposite sides thereof peripheral rollers which are spaced apart from each other, and first and second rollers of the second roller unit may be placed, respectively, between the central and peripheral rollers of the first roller unit, and the first and second rollers of the second roller unit may be spaced apart from each other and rotate the first roller unit when the second roller unit rotates.

Further, in order to accomplish the above objects, the present invention provides a liquid-material application apparatus with a dual roller structure, including a body having a space for holding contents therein, with a first discharge port being formed on an upper portion of the body to discharge the contents; a first roller support placed on an upper portion of the body, and having on a lower surface thereof a second discharge port which communicates with the first discharge port; a first roller unit rotatably placed on an upper portion of the first roller support, and making contact with the contents which are discharged from the second discharge port; a second roller support placed on the first roller support, and having a slit to permit a surface of the first roller unit to protrude therethrough; and a second roller unit rotatably coupled to the second roller support in such a way as to be in contact with the first roller unit which protrude through the slit, wherein, when the second roller unit rotates, the first roller unit rotates while being in contact with the second roller unit, thus transferring the contents from the second discharge port to the second roller unit.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

The present invention may be generally used as an application apparatus for a liquid cosmetic container. However, the present invention may be applied to various types of application apparatuses for discharging and applying liquid contents, without being limited to the application apparatus for the liquid cosmetic container. For example, the present invention may also be applied to an application apparatus for liquid medicines or liquid paint.

A 'dual roller structure' used herein is not limited to two rollers, but means that it has two roller units. If a first roller unit has one roller and a second roller unit has one roller, the total number of rollers is two. However, if the first roller unit has two rollers and the second roller unit has one roller, the total number of rollers is three.

Hereinafter, a liquid-material application apparatus with a dual roller structure according to the present invention will be described in detail with reference to the accompanying drawings.

Figure 1:
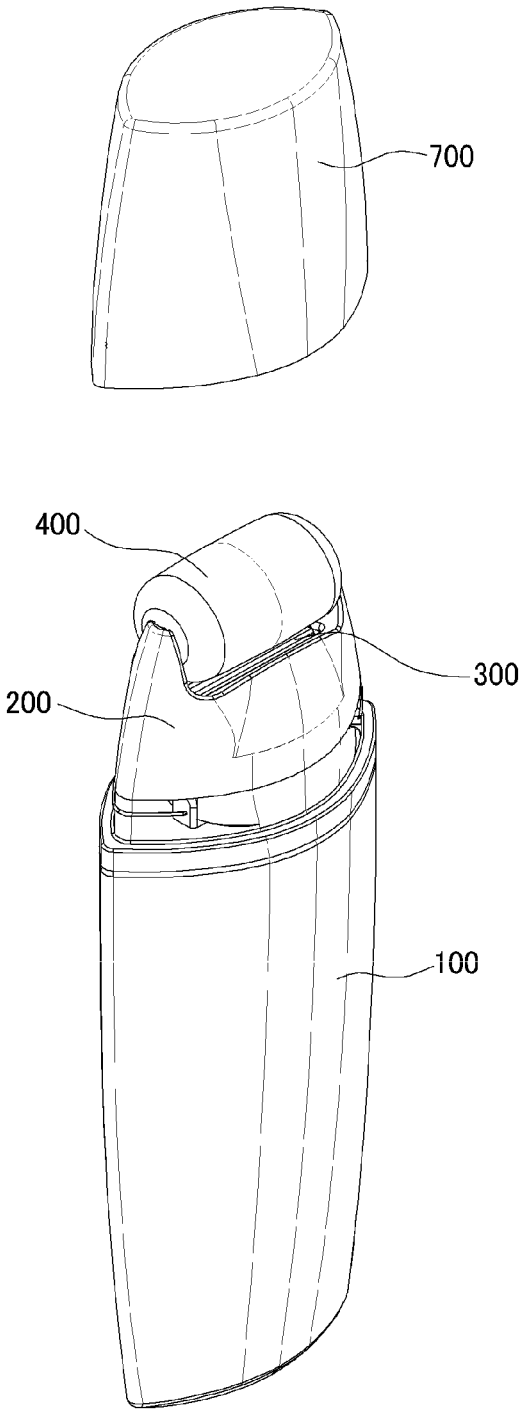
FIG. 1 is a perspective view showing a liquid-material application apparatus with a dual roller structure according to the present invention.
Figure 2:
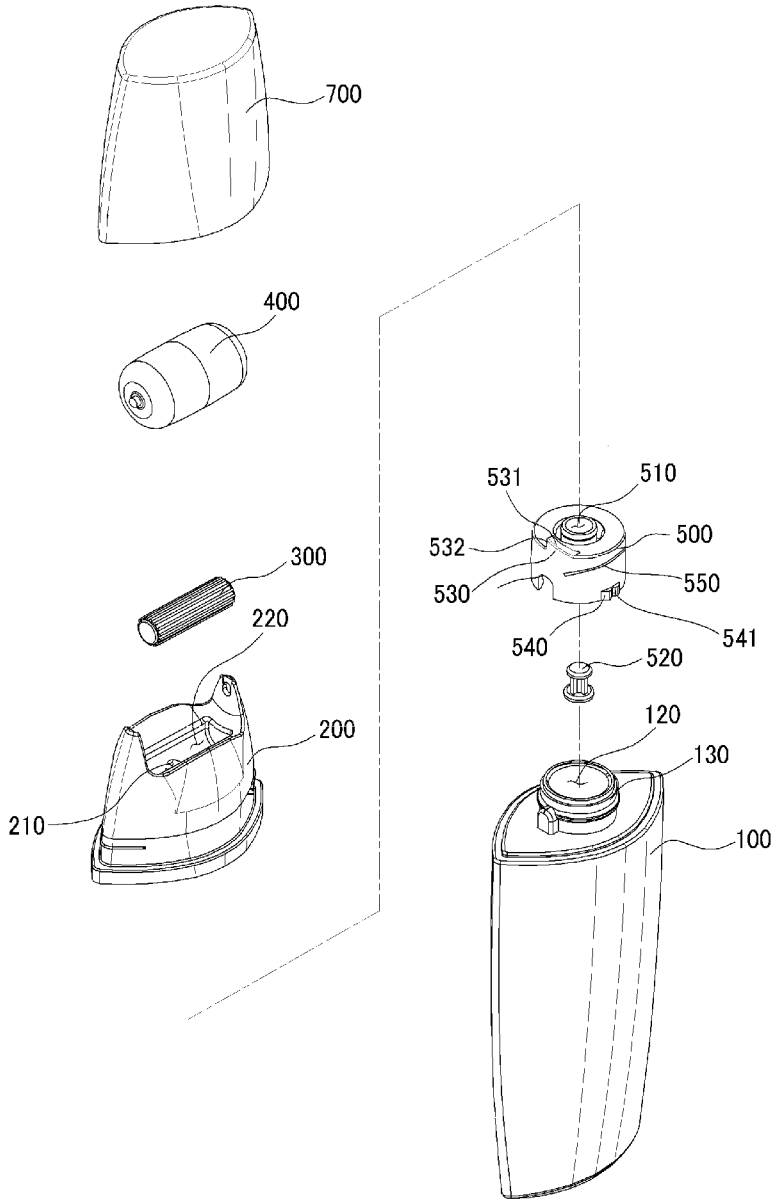
FIG. 2 is an exploded perspective view showing a liquid-material application apparatus with a dual roller structure according to an embodiment of the present invention.
Figure 3:
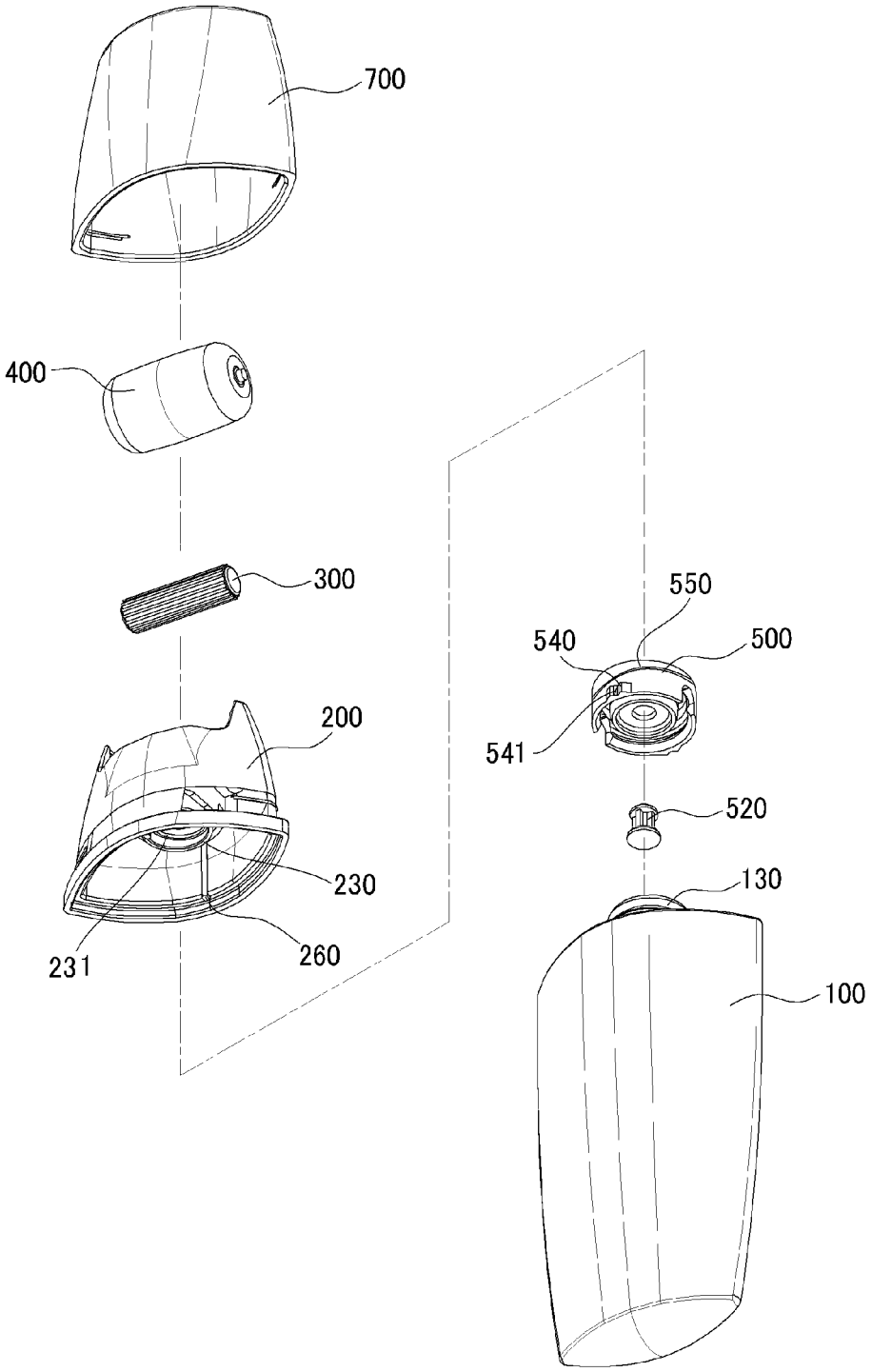
FIG. 3 is an exploded perspective view showing the liquid-material application apparatus with the dual roller structure, when viewed from an angle different from that shown in FIG. 2.

FIG. 1 is a perspective view showing a liquid-material application apparatus with a dual roller structure according to the present invention. FIG. 2 is an exploded perspective view showing a liquid-material application apparatus with a dual roller structure according to an embodiment of the present invention. FIG. 3 is an exploded perspective view showing the liquid-material application apparatus with the dual roller structure, when viewed from an angle different from that shown in FIG. 2.

Figure 4:
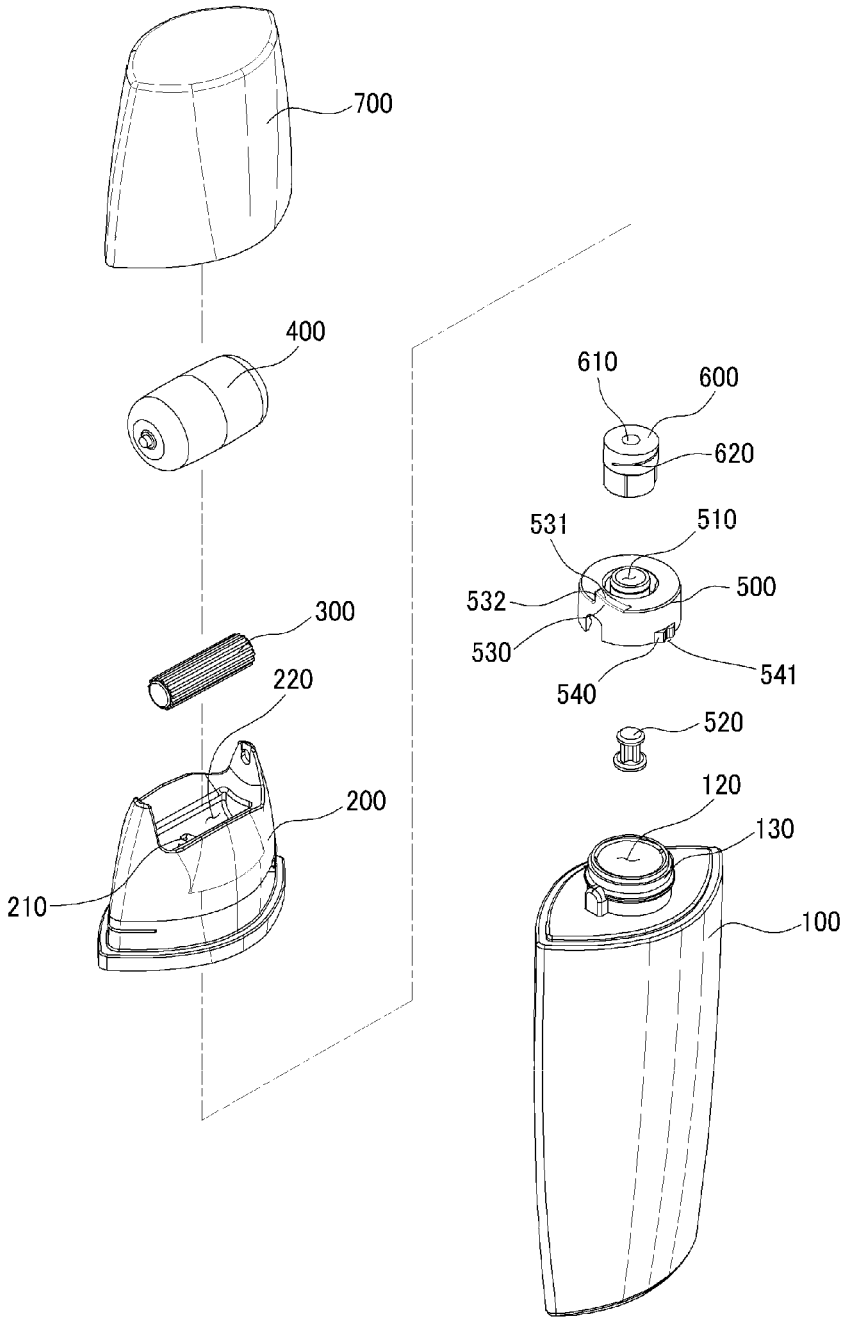
FIG. 4 is an exploded perspective view showing a liquid-material application apparatus with a dual roller structure according to another embodiment of the present invention.
Figure 5:
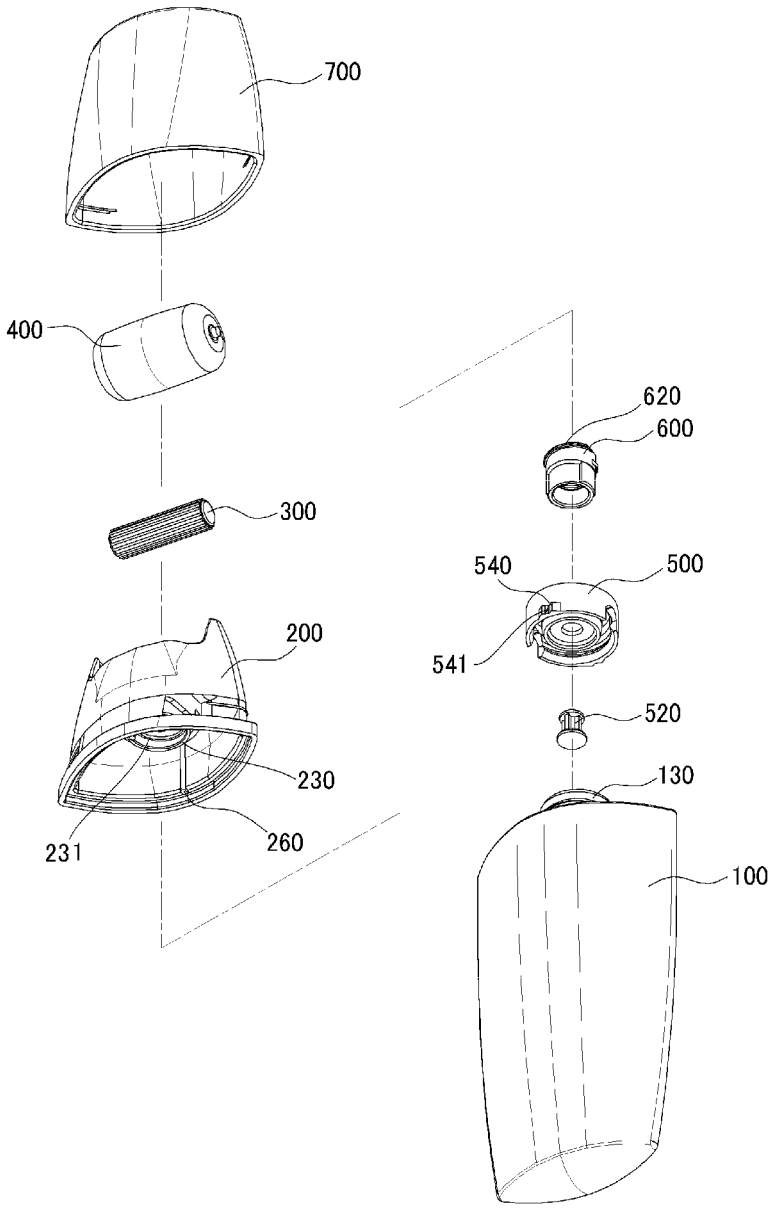
FIG. 5 is an exploded perspective view showing the liquid-material application apparatus with the dual roller structure, when viewed from an angle different from that shown in FIG. 4.
Figure 6:
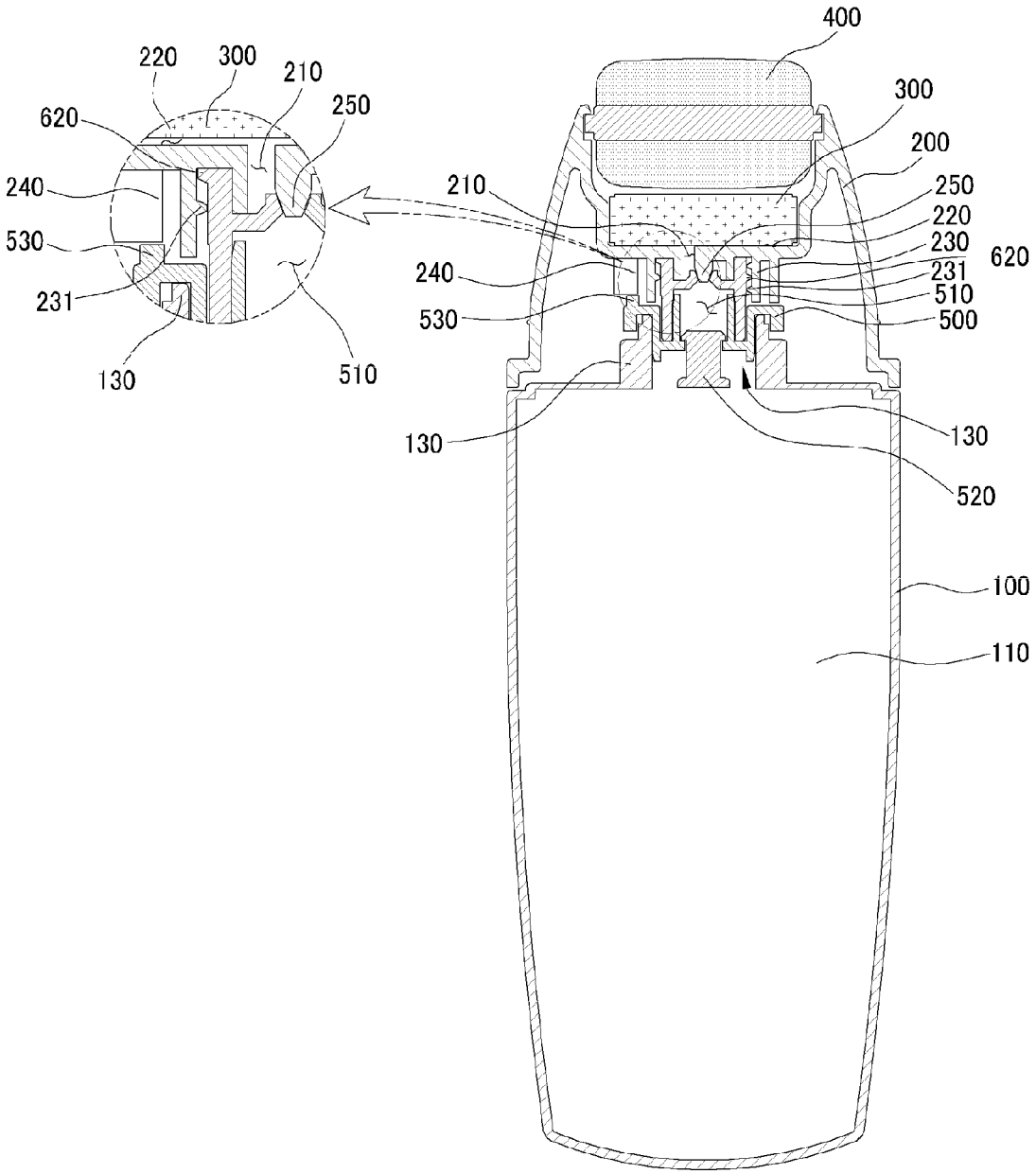
FIG. 6 is a sectional view showing the liquid-material application apparatus with the dual roller structure of FIG. 4.

Further, FIG. 4 is an exploded perspective view showing a liquid-material application apparatus with a dual roller structure according to another embodiment of the present invention. FIG. 5 is an exploded perspective view showing the liquid-material application apparatus with the dual roller structure, when viewed from an angle different from that shown in FIG. 4. FIG. 6 is a sectional view showing the liquid-material application apparatus with the dual roller structure of FIG. 4.

As shown in FIG. 1, the liquid-material application apparatus according to the present invention includes a body 100, a roller support 200, a first roller unit 300, and a second roller unit 400. The second roller unit 400 rotates while being in contact with a place on which application is to be performed, such as the skin. If the second roller unit 400 rotates, the first roller unit 300 making contact with the second roller unit 400 also rotates.

According to the present invention, the body 100 has a space 110 to hold contents therein. A first discharge port 120 is formed in an upper portion of the body 100 to discharge contents held in the space 110 (see FIGS. 2 to 6).

The space 110 in the body 100 holds liquid material, such as liquid cosmetic material or medical ointment. When a user pressurizes the body 100 by pumping it with his or her hand, the liquid material held in the space 110 of the body 100 is discharged through the first discharge port 120.

The roller support 200 is placed on the upper portion of the body 100, as shown in FIGS. 1 to 6.

The roller support 200 receives the first and second roller units 300 and 400. As shown in FIGS. 2 and 4, a second discharge port 210 is formed on a lower surface of the roller support 200 and communicates with the first discharge port 120.

The first roller unit 300 received in the roller support 200 is disposed above the lower surface of the roller support 200, and is in contact with contents which are discharged from the second discharge port 210. The second roller unit 400 is disposed on a side of the first roller unit 300 in such a way as to be in contact with the first roller unit 300.

When the second roller unit 400 rotates while being in contact with the surface on which application is to be performed, the first roller unit 300 is in contact with the second roller unit 400 and so rotates in conjunction with the second roller unit 400.

When the first and second roller units 300 and 400 rotate, contents discharged from the second discharge port 210 are transferred through the first roller unit 300 to the second roller unit 400.

The first and second roller units 300 and 400 according to the present invention may be made of soft material, such as a puff or a sponge, or may be made of hard material, according to the characteristics of the operation of application or the place on which application is to be made.

As shown in FIGS. 2 and 4, a concave part 220 is formed above the lower surface of the roller support 200 according to the present invention to receive the first roller unit 300 therein.

The concave part 220 is formed by depressing the lower surface of the roller support 200 down in a concave manner. The concave part 220 is formed in a shape corresponding to that of the first roller unit 300, so that the first roller unit 300 may be received in the concave part 220.

As shown in FIGS. 2 and 4, the second discharge port 210 is formed on the concave part 220 of the present invention to communicate therewith. Preferably, a depressed portion (see FIG. 10) is formed in the surface of the concave part 220 on which the second discharge port 210 is formed, so that contents discharged from the second discharge port 210 are temporarily held in the depressed portion before the contents make contact with the first roller unit 300.

As shown in FIGS. 2 to 5, a coupling projection 130 is provided on an upper portion of the body 100 according to the present invention in such a way as to project upwards, with the first discharge port 120 being formed on an upper portion of the coupling projection 130.

The coupling projection 130 is coupled with an extension part 500 that will be described below, and extends upwards from the upper portion of the body 100.

The coupling projection 130 may be formed in various shapes. According to this embodiment, as shown in FIGS. 2 to 5, the coupling projection 130 has the shape of a pipe which has at a central portion thereof the first discharge port 120.

The extension part 500 is coupled to the coupling projection 130. As shown in FIGS. 2 to 5, a through hole 510 is formed in a central portion of the extension part 200 to communicate with the first discharge port 120.

Thus, liquid contents discharged through the first discharge port 120 move through the through hole 510. A check valve 520 which is wide at upper and lower ends thereof may be provided in the through hole 510.

As shown in FIGS. 2 to 5, if the check valve 520 is disposed in the through hole 510, the check valve 520 moves up and down in the through hole 510 because of the difference between the pressure of the space 110 and the external pressure, thus opening or closing the through hole 510.

If the pressure of the space 110 is higher than the external pressure, the check valve 520 moves up in the through hole 510 until the lower end of the check valve 520 closes the through hole 510. During the movement of the check valve 520, the through hole 510 is temporarily opened, so that liquid contents held in the space 110 are discharged to the outside of the body 100.

In contrast, if the external pressure is higher than the pressure of the space 110, the check valve 520 moves down in the through hole 510 until the upper end of the check valve 520 closes the through hole 510. In this case, since the external pressure is higher than the pressure of the space 110, the contents are not discharged from the space 110. Such a state may occur when the body 100 pressurized by a user returns to its original state.

Meanwhile, if the pressure of the space 110 is equal to the external pressure, the check valve 520 may move in the direction of gravity. In the present invention, the principle whereby the body 100 is pressurized by a user and the pressurized body 100 returns to its original state is important.

The extension part 500 according to the present invention may have a cylindrical shape, as shown in FIGS. 2 and 3. Preferably, as shown in FIG. 3, a coupling piece 230 which is rotatably coupled with the extension part 500 is provided on the lower surface of the roller support 200.

As shown in FIGS. 2 and 3, the coupling piece 230 may be directly coupled to the extension part 500. Further, as shown in FIGS. 4 and 5, the coupling piece 230 may be coupled to the extension part 500 via a nozzle 600 which is mounted to the extension part 500.

In the nozzle 600 shown in FIGS. 4 and 5, an outlet 610 is formed in the upper end of the nozzle 600 in such a way as to communicate with the through hole 510 of the extension part 500.

As shown in FIGS. 4 and 5, the nozzle 600 may be assembled with the extension part 500. Alternatively, the nozzle 600 may be integrated with the extension part 500.

In the liquid-material application apparatus according to the present invention, as shown in FIGS. 2 and 3, a projection 250 (see FIG. 6) may be provided on the lower surface of the roller support 200 in such a way as to extend downwards, thus opening or closing the through hole 510.

When the roller support 200 moves up and down, the projection 250 opens or closes the through hole 510.

Preferably, as shown in FIGS. 2 and 3, thread grooves 550 are formed on the outer circumference of the extension part 500 according to the present invention. Further, as shown in FIG. 3, threads 231 are formed on the coupling piece 230 to be inserted into the thread grooves 550.

Thus, the roller support 200 may move up along the thread grooves 550 of the extension part 500 according to the direction in which the roller support 200 having the coupling piece 230 rotates. At this time, the projection 250 moves up, thus opening the outlet.

In contrast, if the roller support 200 rotates to move down, the projection 250 moves down, thus closing the outlet.

As shown in FIGS. 4 and 6, when the nozzle 600 is provided on the upper portion of the extension part 500, the projection 250, which is provided on the lower surface of the roller support 200 in such a way as to extend downwards, may open or close the outlet 610.

Thus, when the roller support 200 moves up or down, the projection 250 opens or closes the outlet 610.

As shown in FIGS. 4 to 6, thread grooves 620 may be formed on the outer circumference of the nozzle 600, and threads 231 may be formed on the coupling piece 230 to be inserted into the thread grooves 620.

Thus, if the roller support 200 moves up according to the direction in which the roller support 200 having the coupling piece 230 rotates, the projection 250 also moves up, thus opening the outlet 610. In contrast, if the roller support 200 moves down, the projection 250 also moves down, thus closing the outlet 610.

As shown in FIGS. 4 to 6, a guide piece 530 protrudes from the upper portion of the extension part 500 of the liquid-material application apparatus according to the present invention, and a contact piece 240 is provided on the lower surface of the roller support 200 to be in contact with the guide piece 530, as shown in FIG. 6. When the roller support 200 rotates so that the guide piece 530 comes into contact with the contact piece 240, the projection 250 is in a position that opens the through hole 510 or the outlet 610.

Figure 7:
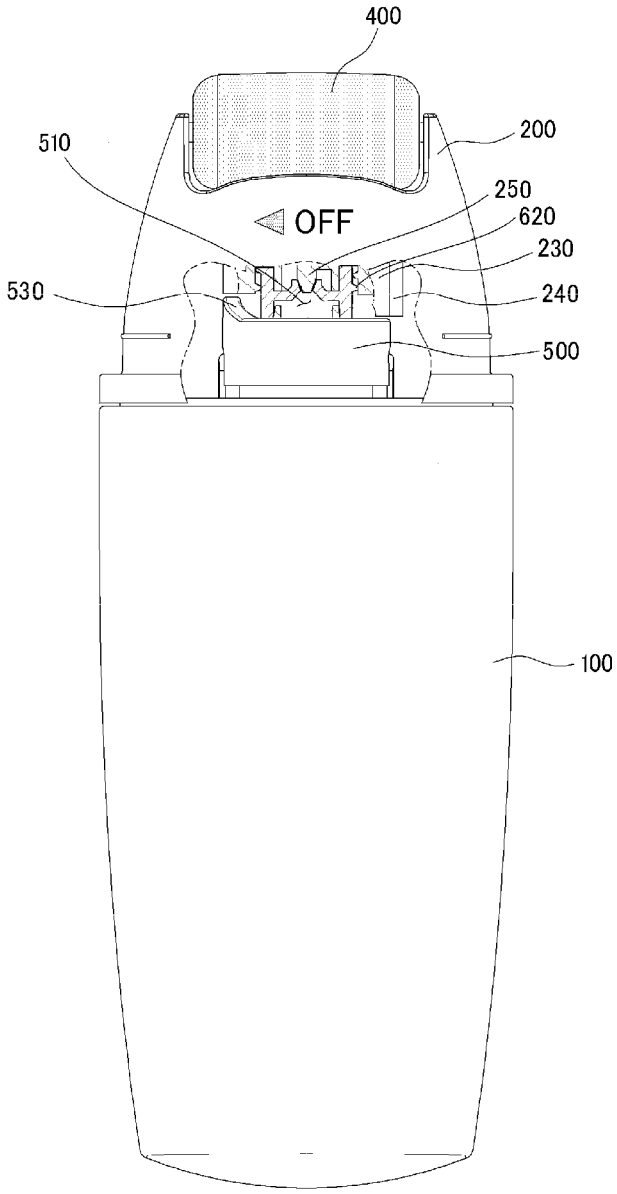
FIGS. 7 to 9 are operational views of the liquid-material application apparatus with the dual roller structure according to the present invention.
Figure 8:
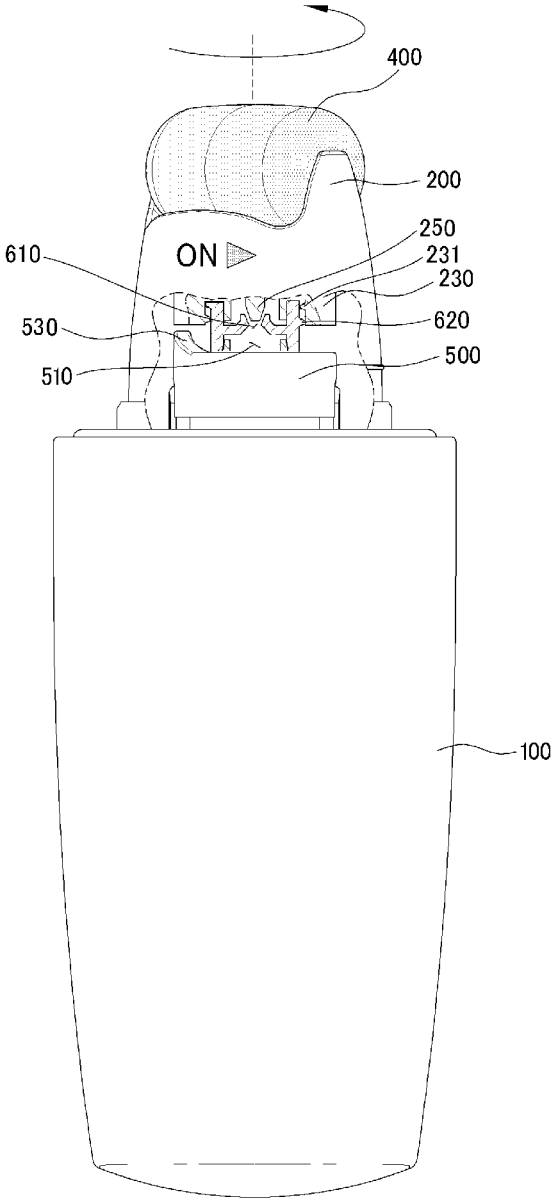
Figure 9:
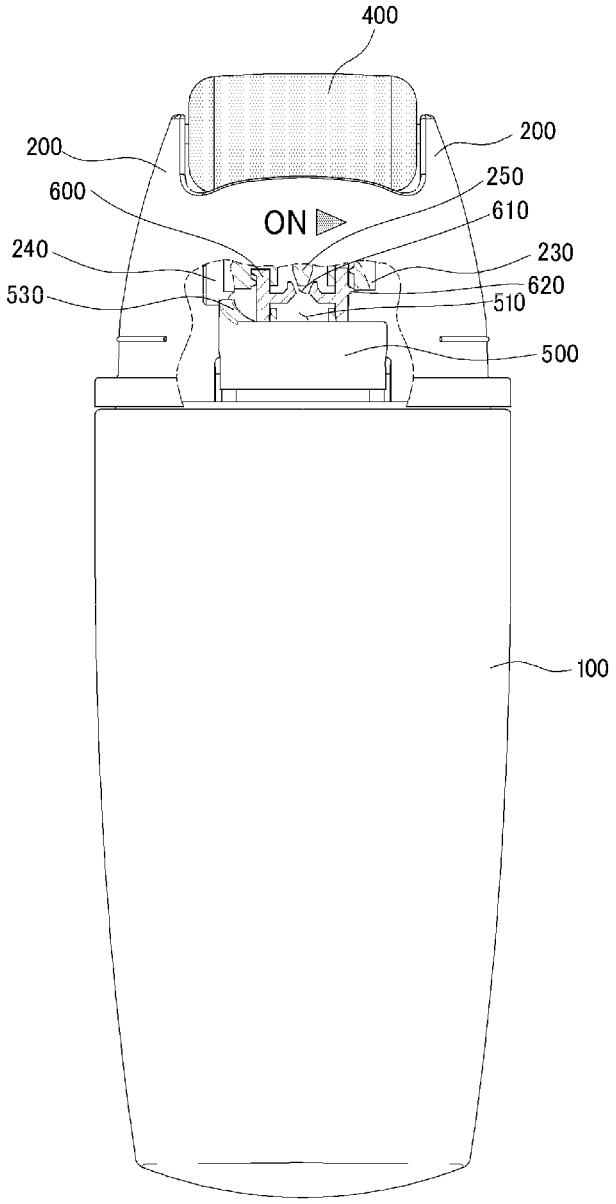

FIGS. 7 to 9 are operational views of the liquid-material application apparatus with the dual roller structure according to the present invention. The process of closing the outlet 610 of the nozzle 600 by the projection 250 will be described with reference to FIGS. 7 to 9.

FIG. 7 shows a case wherein the guide piece 530 and the contact piece 240 are on opposite sides of the through hole 510 of the extension part 500.

If the coupling projection 130 of the roller support 200 is at the lowermost position along the thread grooves 620 of the nozzle 600, the projection 250 of the roller support 200 moves down and closes the outlet 610 of the nozzle 600.

In this state, the projection 250 comes into contact with the outlet 610 of the nozzle 600 as shown in FIG. 7, so that the roller support 200 may not rotate any further down along the thread grooves 620 of the nozzle 600.

If the roller support 200 rotates in the state of FIG. 7, so that the coupling projection 230 of the roller support 200 moves along the thread grooves 620 of the nozzle 600 as shown in FIG. 8, the roller support 200 moves up.

At this time, the projection 250 provided on the lower portion of the roller support 200 also moves up. Thus, the projection 250 is spaced apart from the outlet 610 of the nozzle 600, so that the outlet 610 of the nozzle 600 is in the open position.

When the roller support 200 is further rotated from the position of FIG. 8 to a position of FIG. 9, the contact piece 240 provided on the roller support 200 comes into contact with the guide piece 530 provided on the extension part 500, and stops any further rotation of the roller support 200.

At this time, since the roller support 200 has moved to an upper position than the position of FIG. 8, the outlet 610 of the nozzle 600 is more widely open.

If the contact piece 240 and the guide piece 530 rotate at 180 degrees as shown in FIGS. 7 to 9, the contact piece 240 and the guide piece 530 may be on opposite sides of the through hole 510 so that the contact piece 240 comes into contact with the guide piece 530. However, it is obvious to those skilled in the art that the positions of the contact piece 240 and the guide piece 530 may change depending on the amount of liquid material discharged from the container 100.

When the coupling piece 230 is directly coupled to the extension part 500 having the thread grooves 550 as shown in FIGS. 2 and 3, the guide piece 530 may be formed on the upper portion of the extension part 500, as shown in FIGS. 2 and 3.

Here, the contact piece 240, which is in contact with the guide piece 530, is preferably formed on the inner surface of the coupling piece 230.

Preferably, a protrusion 540 having a seating groove 541 is provided on a side surface of the extension part 500 according to the present invention as shown in FIGS. 2 to 5, and a protruding piece 260 which makes contact with the protrusion 540 is formed on the lower surface of the roller support 200, as shown in FIGS. 3 and 5.

The protrusion 540 and the protruding piece 260 may perform the function of informing a user of the position to which the roller support 200 has rotated, and the function of controlling the rotation. When the roller support 200 rotates, the protruding piece 260 is inserted into the seating groove of the protrusion 540 to hinder the smooth rotation of the roller support 200, thus informing a user of the position to which the roller support 200 has rotated.

The protrusion 540 and the protruding piece 260 may be formed at various positions. When the through hole 510 or the outlet 610 is opened or closed, it is preferable that the protruding piece 260 be seated in the seating groove 541.

Figure 10:
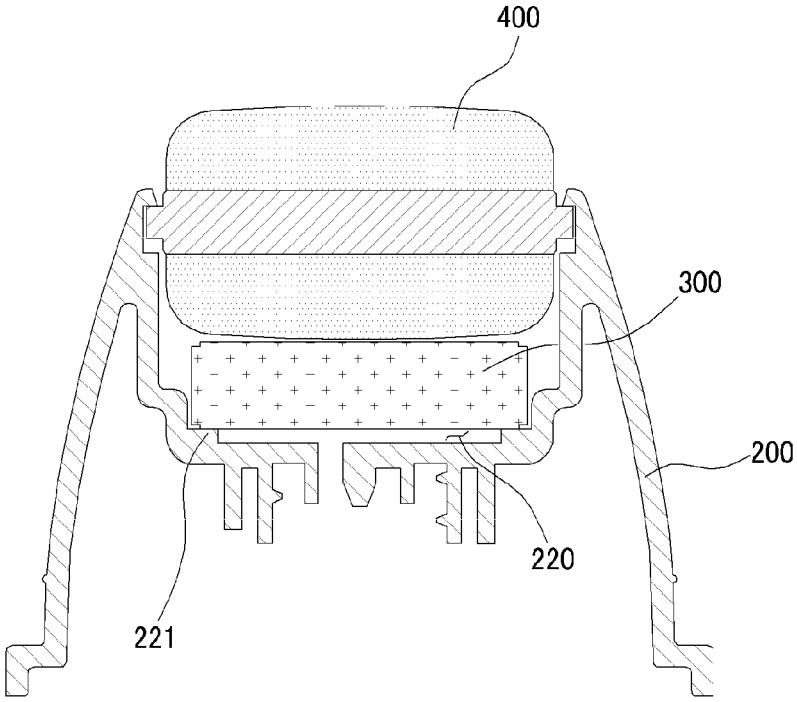
FIG. 10 is a partial sectional view showing a liquid-material application apparatus with a dual roller structure according to another embodiment of the present invention.
Figure 11:
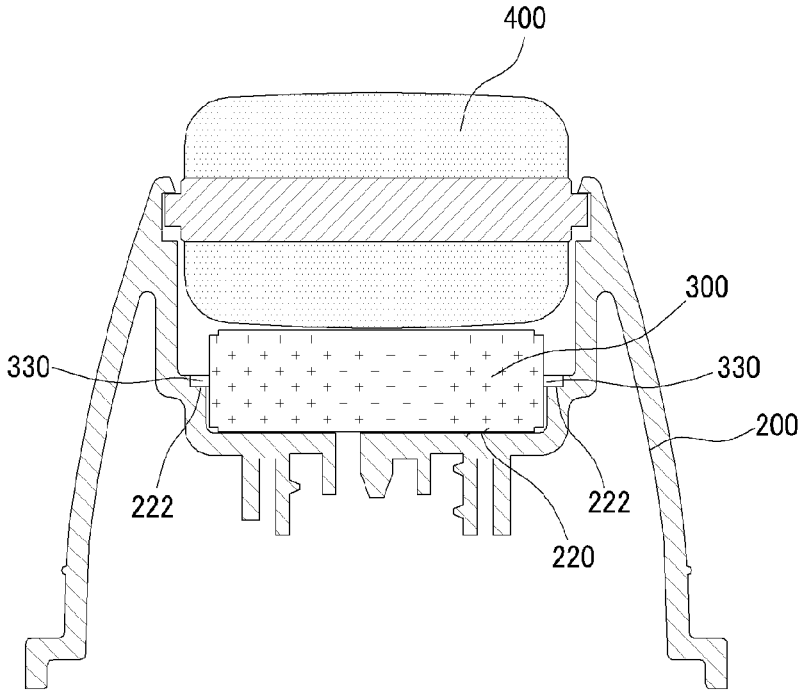
FIG. 11 is a partial sectional view showing a liquid-material application apparatus with a dual roller structure according to a further embodiment of the present invention.
Figure 12:
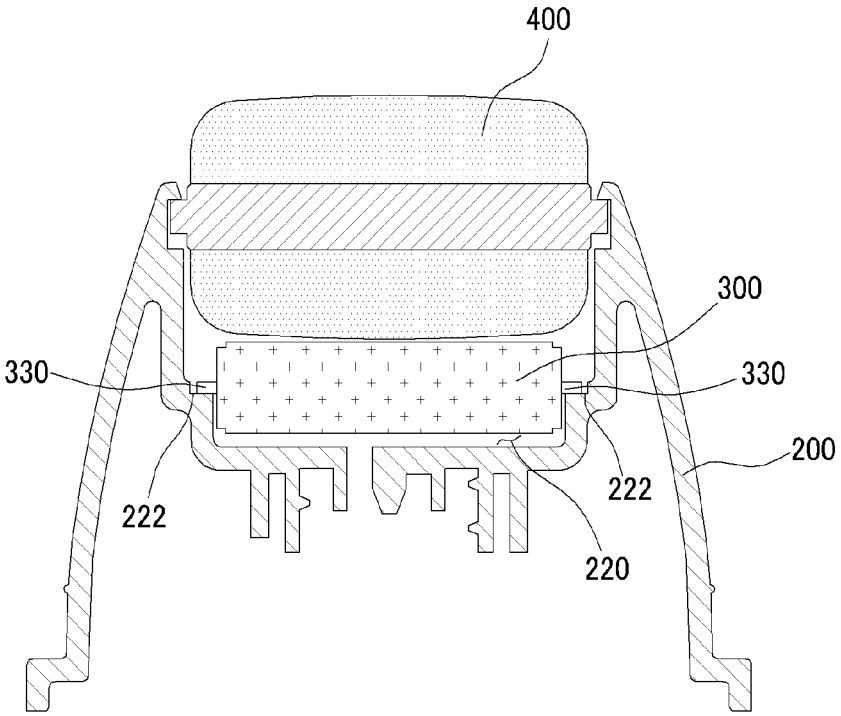
FIG. 12 is a partial sectional view showing a liquid-material application apparatus with a dual roller structure according to a further embodiment of the present invention.

FIGS. 10 to 12 are partial sectional views showing liquid-material application apparatuses with dual roller structures according to other embodiments of the present invention. Referring to the drawings, the concave part 220 and the first roller unit 300 may be formed as follows.

A step 221 may be formed on an edge of the concave part 220 so that both ends of the first roller unit 300 are seated thereon, thus allowing a bottom surface of the concave part 220 and the first roller unit 300 to be spaced apart from each other (see FIG. 10).

In this case, liquid contents discharged from the second discharge port 210 may be evenly distributed between a space between the first roller unit 300 and the concave part 200. Thus, the liquid contents may be more uniformly applied to the first roller unit 300.

Further, in order to more smoothly rotate the first roller unit 300, a rotating shaft 330 may be provided on each of opposite ends of the first roller unit 300 (see FIG. 11). Further, a shaft insert groove 222 may be formed in an edge of the concave part 220 so that the rotating shaft 330 is seated therein.

Here, a height of the shaft insert groove 222 from the lower surface of the concave part 200 corresponds to a distance from the outer circumference of the first roller unit 300 to the rotating shaft 330. Thereby, when the first roller unit 300 having the rotating shaft 330 is seated in the concave part 220, the first roller unit 300 may be in close contact with the bottom surface of the concave part 220.

Further, a height of the shaft insert groove 222 from the lower surface of the concave part 200 may be larger than a distance from the outer circumference of the first roller unit 300 to the rotating shaft 330, thus allowing the bottom surface of the concave part 220 to be spaced apart from the first roller unit 300 (see FIG. 12).

FIGS. 13A to 13E are perspective views showing various embodiments of the first roller unit 300 of the liquid-material application apparatus according to the present invention. The various embodiments of the first roller unit 300 will be described in detail with reference to FIGS. 13A to 13E.

Figure 13:
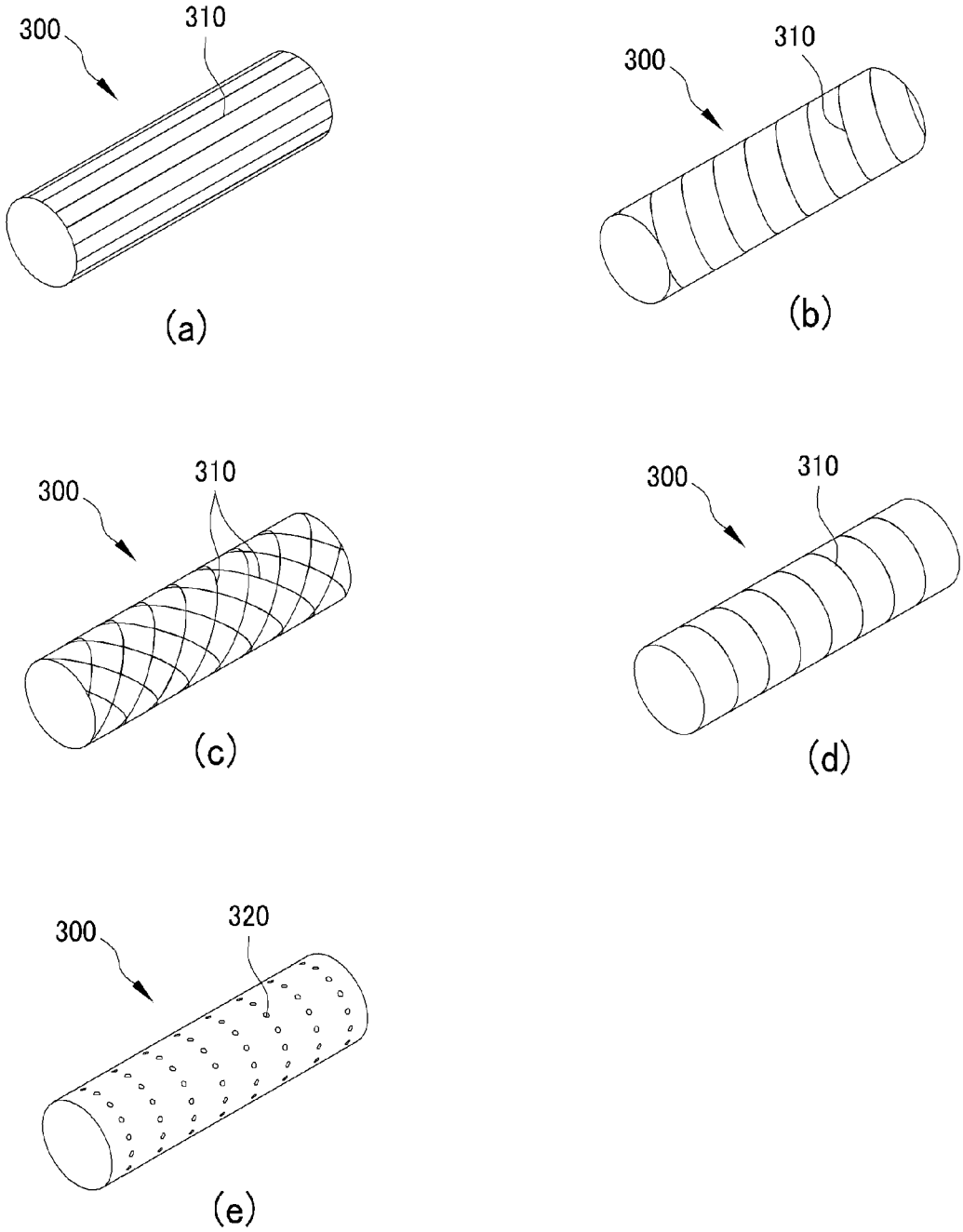
FIGS. 13A to 13E are perspective views showing various embodiments of a first roller unit included in the liquid-material application apparatus with the dual roller structure according to the present invention.

According to the present invention, the first roller unit 300 may have a cylindrical shape. Such a first roller unit 300 may have on an outer surface thereof a plurality of grooves 310. The grooves 310 formed in the first roller unit 300 may be oriented in a direction perpendicular to the direction of rotation of the first roller unit 300 as shown in FIG. 13A, or may be oriented in the same direction as the direction of rotation as shown in FIG. 13D. The grooves 310 may be continuously or discontinuously formed.

Further, the grooves 310 of the first roller unit 300 according to the present invention may be continuously formed in a direction which is inclined relative to the rotating direction of the first roller unit 310, as shown in FIG. 13B, or may be discontinuously formed according to an embodiment. Further, the grooves 310 may cross each other as shown in FIG. 13C.

A plurality of protrusions 320 may be formed on the outer surface of the first roller unit 300 according to the present invention, as shown in FIG. 13E. Further, a plurality of depressions (not shown) may be formed concavely in the first roller unit 300.

The grooves 310 formed on the outer surface of the first roller unit 300 may be formed at various depths and intervals according to embodiments. The protrusions 220 of FIG. 13E may also be formed in various shapes.

FIGS. 14A to 14G are views showing various embodiments of the first and second roller units 300 and 400 according to the present invention. The first and second roller units 300 and 400 will be described in detail with reference to FIGS. 14A to 14G.

As shown in FIGS. 14B to 14G, it is preferable that at least one of the first and second roller units 300 and 400 include a plurality of rollers.

Figure 14:
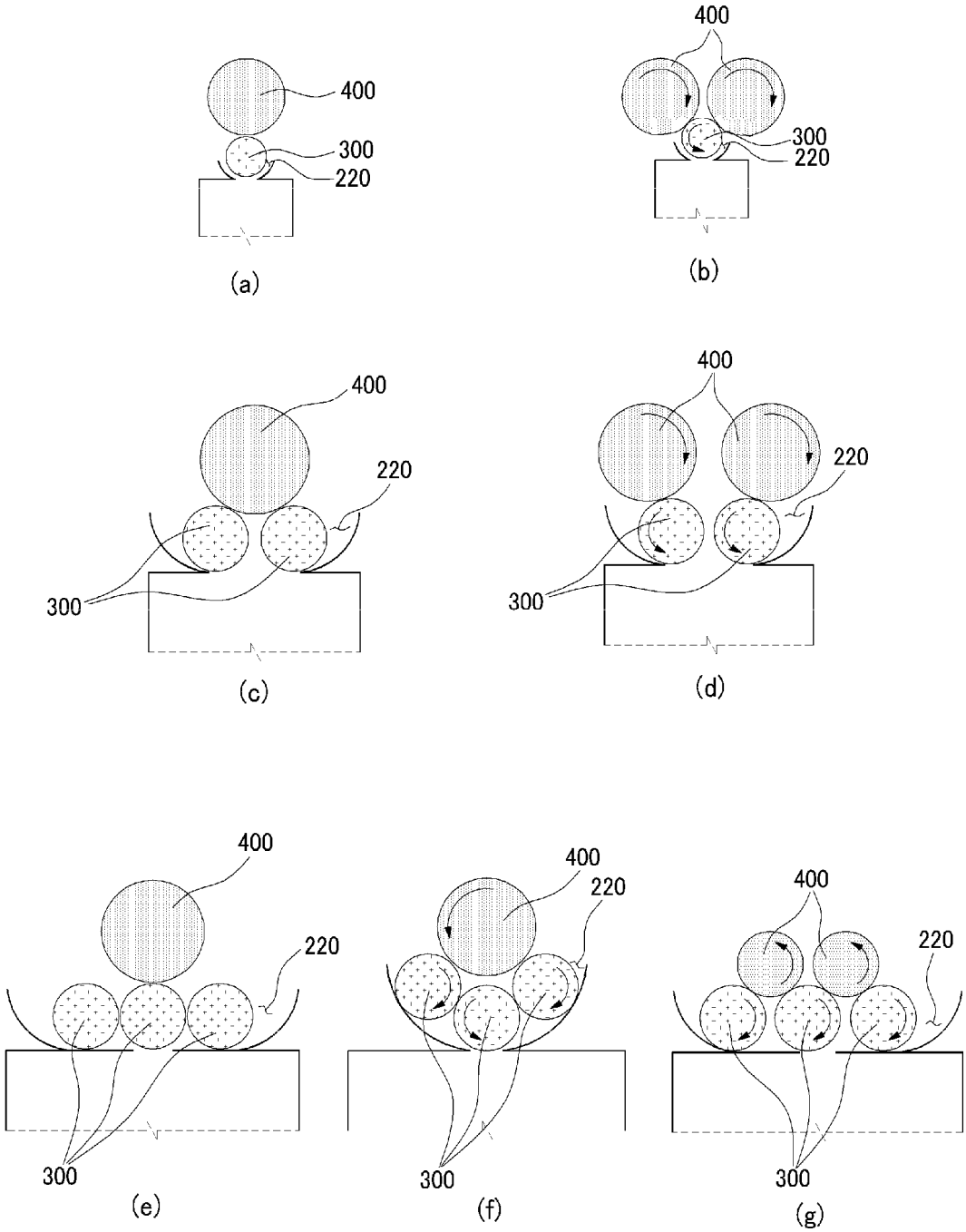
FIGS. 14A to 14G are views showing various arrangements of first and second roller units included in the liquid-material application apparatus with the dual roller structure according to the present invention.

As shown in FIG. 14B, the first roller unit 300 may include one roller, and the second roller unit 400 may include two rollers. In this case, it is preferable that the roller of the first roller unit 300 be arranged between the rollers of the second roller unit 400 in such a way as to be put in contact with the rollers of the second roller unit 400. It is preferable that the rollers of the second roller unit 400 be spaced apart from each other.

When the first and second roller units 300 and 400 are arranged as shown in FIG. 14B, the two rollers of the second roller unit 400 rotate in the same direction. At this time, the roller of the first roller unit 300 rotates in a direction opposite to the rollers of the second roller unit 400, thus transmitting contents from the second discharge port 210 to the rollers of the second roller unit 400.

Thus, the contents transmitted to the second roller unit 400 may be evenly applied over a larger area.

Further, as shown in FIG. 14C, the first roller unit 300 may include two rollers, and the second roller unit 400 may include one roller.

In this case, it is preferable that the rollers of the first roller unit 300 be arranged to be in contact with the roller of the second roller unit 400. It is preferable that the rollers of the first roller unit 300 be spaced apart from each other.

In this case, one pair of rollers of the first roller unit 300 are rotated in the same direction by the roller of the second roller unit 400, thus transmitting contents from the second discharge port 210 to the roller of the second roller unit 400.

Since the first roller unit 300 of FIG. 14C includes two rollers, the contents discharged from the second discharge port 210 may be evenly spread over a larger area of the roller of the second roller unit 400.

Further, as shown in FIG. 14D, the first roller unit 300 may include two rollers, and the second roller unit 400 may include two rollers.

In this case, the first and second roller units 300 and 400 may be arranged such that a first roller of the first roller unit 300 makes contact with a first roller of the second roller unit 400, and a second roller of the first roller unit 300 makes contact with a second roller of the second roller unit 400. Preferably, the first and second rollers of the first roller unit 300 are spaced apart from each other, and the first and second rollers of the second roller unit 400 are spaced apart from each other.

In this case, contents discharged from the second discharge port 210 are applied to the first and second rollers of the first roller unit 300, so that the contents may be independently transferred to the first and second rollers of the second roller unit 400. Thus, each roller of the second roller unit 400 may independently perform an application function.

Further, as shown in FIG. 14E, the first roller unit 300 may include three rollers, and the second roller unit 400 may include one roller.

In this case, a central roller of the first roller unit 300 makes contact with the roller of the second roller unit 400. Further, peripheral rollers may be provided on opposite sides of the central roller. The peripheral rollers are spaced apart from the roller of the second roller unit 400, and make contact with the central roller.

In this case, first, liquid contents discharged from the second discharge port 210 are applied to the central roller of the first roller unit 300, which is placed above the second discharge port 210. Subsequently, the liquid contents are transferred from the central roller to the peripheral rollers of the first roller unit 300. Since the central roller makes contact with the peripheral rollers, the liquid contents may be transferred to the second roller unit 400 while being evenly applied over a larger area.

Further, as shown in FIG. 14F, the first roller unit 300 may include three rollers, and the second roller unit 400 may include one roller.

Peripheral rollers of the first roller unit 300 are provided on opposite sides of the central roller of the first roller unit 300 in such a way as to make contact with the central roller of the first roller unit 300. Here, the roller of the second roller unit 400 may be arranged to make contact with the peripheral rollers of the first roller unit 300.

Preferably, the central roller of the first roller unit 300 is spaced apart from the roller of the second roller unit 400.

In this case, first, contents discharged from the second discharge port 210 are applied to the central roller of the first roller unit 300, which is placed above the second discharge port 210. Subsequently, the contents are evenly transferred from the central roller to the peripheral rollers which are placed on opposite sides of the central roller, and thereafter are transmitted from the peripheral rollers to the roller of the second roller unit 400. Such an operation allows the liquid contents to be more evenly spread onto the roller of the second roller unit 400.

Further, as shown in FIG. 14G, the first roller unit 300 may include three rollers, and the second roller unit 400 may include two rollers.

Peripheral rollers of the first roller unit 300 may be provided on opposite sides of the central roller of the first roller unit 300 in such a way that the rollers are spaced apart from each other. Here, first and second rollers of the second roller unit 400 are arranged, respectively, between the central roller and the peripheral rollers of the first roller unit 300, thus rotating the rollers of the first roller unit 300.

While the central and peripheral rollers of the first roller unit 300 and the first roller of the second roller unit 400, that is, three rollers, rotate together, liquid contents transferred to the first roller of the second roller unit 400 are more evenly spread.

Preferably, the first and second rollers of the second roller unit 400 are spaced apart from each other.

The number and arrangement of the first and second roller units 300 and 400 are not limited to the embodiments described and shown herein, and thus may be variously changed.

Figure 15:
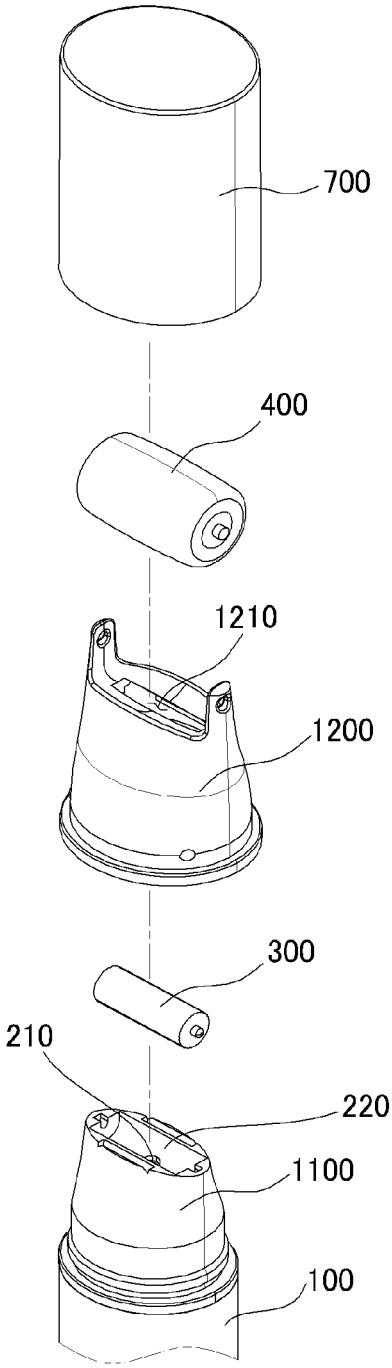
FIG. 15 is an exploded perspective view showing a liquid-material application apparatus with a dual roller structure according to another embodiment of the present invention.

FIG. 15 is an exploded perspective view showing a liquid-material application apparatus according to another embodiment of the present invention. The liquid-material application apparatus will be described with reference to FIG. 15.

The liquid-material application apparatus according to the present invention includes a body 100, a first roller support 1100, a first roller unit 300, a second roller support 1200, and a second roller unit 400.

Among the components of the liquid-material application apparatus according to the present invention, the body 100, the first roller unit 300, and the second roller unit 400 have been described above. In order to avoid duplicating the description, the description of the body 100, the first roller unit 300, and the second roller unit 400 will be skipped. The first and second roller supports 1100 and 1200 will be described below in detail.

The first roller support 1100 is placed on the top of the body 100, and has on its lower surface a second discharge port 210 which communicates with the first discharge port 120. A concave part 220 is formed in an upper portion of the first roller support 1100 so that the first roller unit 300 is placed therein. The second discharge port 210 is formed to communicate with the concave part 220.

The second roller support 1200 is rotatably coupled with the second roller unit 400. A slit 1210 is formed through a lower surface of the second roller support 1200 so that a surface of the first roller unit 300 protrudes through the slit 1210 when the second roller support 1200 is coupled to the first roller support 1100.

The second roller unit 400 is coupled to the second roller support 1200 in such a way as to be put in contact with the first roller unit 300 protruding through the slit 1210.

Thus, when the second roller unit 400 rotates, the first roller unit 300 rotates while it is in contact with the second roller unit 400, so that contents discharged from the second discharge port 210 are transferred to the second roller unit 400.

The above-mentioned first roller unit 300 of the liquid-material application apparatus may comprise a plurality of balls, according to an embodiment. Further, the body 100 may be covered with a cap 700 so as to protect the second roller unit 400, as shown in FIGS. 1 to 5 and FIG. 15.

As described above, a liquid-material application apparatus with a dual roller structure according to the present invention achieves the following effects by interaction between a plurality of rollers.

The present invention provides a liquid-material application apparatus, which allows liquid material to be evenly spread over a second roller unit using a first roller unit, thus enabling the liquid material to be evenly applied to a place which is in contact with the second roller unit, such as the skin.

The present invention provides a liquid-material application apparatus, which prevents liquid material from adhering to an undesired place during the operation of applying the liquid material.

The present invention provides a liquid-material application apparatus, which enables the discharge of liquid material to be easily controlled by rotating to the left or right.

The effects of the present invention are not limited to the above-mentioned effects, and other effects which are not mentioned could be clearly understood by those skilled in the art from the description.

It is to be understood that the form of the invention herein shown and described above is for illustrative purposes only. Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A liquid-material application apparatus with a dual roller structure, comprising:

a body having a space for holding contents therein, with a first discharge port being formed on an upper portion of the body to discharge the contents;

a roller support mounted on an upper portion of the body and having, on a lower surface thereof, a second discharge port which communicates with the first discharge port, a concave part formed above the lower surface of the roller support;

a first roller unit rotatably mounted on a lower portion of the roller support such that the first roller unit is disposed at the concave part, and making contact with the contents which are discharged from the second discharge port; and a second roller unit rotatably mounted on an upper portion of the roller support in such a way as to be put in contact with the first roller unit, the second roller unit positioned over the first roller unit, wherein, when the second roller unit rotates, the first roller unit rotates while being in contact with the second roller unit such that the first roller unit transfers the contents discharged from the second discharge port to the second roller unit, wherein a step is provided on an edge of the concave part such that the first roller unit is seated at opposite ends thereof on the step, thus spacing a bottom surface of the concave part and the first roller unit apart from each other.

2. The liquid-material application apparatus as set forth in claim 1, wherein the second discharge port is formed on the concave part to communicate therewith.

3. The liquid-material application apparatus as set forth in claim 1, wherein a rotating shaft is provided on each of opposite ends of the first roller unit, and a shaft insert groove is provided on opposite ends of the concave part so that the rotating shaft is seated therein.

4. The liquid-material application apparatus as set forth in claim 3, wherein the shaft insert groove is formed to space the bottom surface of the concave part and the first roller unit apart from each other when the rotating shaft of the first roller unit is seated in the shaft insert groove.

5. The liquid-material application apparatus as set forth in claim 2, wherein a depressed portion is formed in the concave part to hold contents discharged from the second discharge port, and the second discharge port is formed to communicate with the depressed portion.

6. The liquid-material application apparatus as set forth in claim 1, wherein a coupling projection projects upwards from the upper portion of the body, and the first discharge port is formed an upper portion of the coupling projection.

7. The liquid-material application apparatus as set forth in claim 6, wherein an extension part is coupled to the coupling projection, and includes a through hole communicating with the first discharge port.

8. The liquid-material application apparatus as set forth in claim 7, wherein a check valve is provided in the through hole.

9. The liquid-material application apparatus as set forth in claim 7, wherein the extension part has a cylindrical shape, and the roller support has on the lower surface thereof a coupling piece which is rotatably coupled to the extension part.

10. The liquid-material application apparatus as set forth in claim 9, wherein a projection for opening or closing the through hole is provided on the lower surface of the roller support in such a way as to extend downwards, so that the projection opens or closes the through hole when the roller support moves up or down.

11. The liquid-material application apparatus as set forth in claim 10, wherein thread grooves are formed on an outer circumference of the extension part, and threads are formed on the coupling piece to be inserted into the thread grooves, whereby, if the roller support moves up according to a direction in which the roller support having the coupling piece rotates, the projection moves up, thus opening the outlet, and if the roller support moves down, the projection moves down, thus closing the outlet.

12. The liquid-material application apparatus as set forth in claim 9, wherein a nozzle having an outlet is provided in the through hole, and a projection for opening or closing the outlet is provided on the lower surface of the roller support in such a way as to extend downwards, so that the projection opens or closes the outlet when the roller support moves up or down.

13. The liquid-material application apparatus as set forth in claim 12, wherein thread grooves are formed on an outer circumference of the nozzle, and threads are formed on the coupling piece to be inserted into the thread grooves, whereby, if the roller support moves up according to a direction in which the roller support having the coupling piece rotates, the projection moves up, thus opening the outlet, and if the roller support moves down, the projection moves down, thus closing the outlet.

14. The liquid-material application apparatus as set forth in claim 10, wherein a guide piece protrudes from an upper portion of the extension part, and a contact piece is provided on the lower surface of the roller support to make contact with the guide piece, whereby, when the roller support rotates, so that the guide piece comes into contact with the contact piece, the projection is positioned so as to open the through hole or outlet.

15. The liquid-material application apparatus as set forth in claim 14, wherein the extension part comprises on a side surface thereof a protrusion having a seating groove, and the roller support comprises on the lower surface thereof a protruding piece which is inserted into the seating groove when the roller support rotates, so that the protruding piece is seated into the seating groove when the through hole or outlet is opened or closed.

16. The liquid-material application apparatus as set forth in claim 1, wherein a plurality of grooves is formed on an outer surface of the first roller unit.

17. The liquid-material application apparatus as set forth in claim 16, wherein the grooves are continuously formed in a direction perpendicular to a direction of rotation of the first roller unit or in the same direction as the direction of rotation thereof.

18. The liquid-material application apparatus as set forth in claim 16, wherein the grooves are discontinuously formed in a direction perpendicular to a direction of rotation of the first roller unit or in the same direction as the direction of rotation thereof.

19. The liquid-material application apparatus as set forth in claim 16, wherein the grooves are continuously or discontinuously formed in a direction inclined relative to a direction of rotation of the first roller unit.

20. The liquid-material application apparatus as set forth in claim 19, wherein the grooves cross each other.

21. The liquid-material application apparatus as set forth in claim 1, wherein a plurality of protrusions is formed on the first roller unit.

22. The liquid-material application apparatus as set forth in claim 1, wherein the first roller unit comprises a plurality of ball/round/circular-shaped rollers.

23. The liquid-material application apparatus as set forth in claim 1, wherein at least one of the first and second roller units comprises a plurality of rollers.

24. The liquid-material application apparatus as set forth in claim 23, wherein, when the first roller unit comprises one roller and the second roller unit comprises two rollers, the roller of the first roller unit is placed between first and second rollers of the second roller unit in such a way as to be in contact therewith, and the first and second rollers of the second roller unit are spaced apart from each other.

25. The liquid-material application apparatus as set forth in claim 23, wherein, when the first roller unit comprises two rollers and the second roller unit comprises one roller, first and second rollers of the first roller unit are in contact with the roller of the second roller unit, and the first and second rollers of the first roller unit are spaced apart from each other.

26. The liquid-material application apparatus as set forth in claim 23, wherein, when the first roller unit comprises two rollers and the second roller unit comprises two rollers, a first roller of the first roller unit is in contact with a first roller of the second roller unit, and a second roller of the first roller unit is in contact with a second roller of the second roller unit, the first and second rollers of the first roller unit being spaced apart from each other, and the first and second rollers of the second roller unit being spaced apart from each other.

27. The liquid-material application apparatus as set forth in claim 23, wherein, when the first roller unit comprises three rollers and the second roller unit comprises one roller, a central roller of the first roller unit has on opposite sides thereof two peripheral rollers which are spaced apart from the roller of the second roller unit and are in contact with the central roller.

28. The liquid-material application apparatus as set forth in claim 23, wherein, when the first roller unit comprises three rollers and the second roller unit comprises one roller, a central roller of the first roller unit has on opposite sides thereof two peripheral rollers which are in contact with the central roller, and the roller of the second roller unit is in contact with the peripheral rollers of the first roller unit, and the central roller of the first roller unit and the roller of the second roller unit are spaced apart from each other.

29. The liquid-material application apparatus as set forth in claim 23, wherein, when the first roller unit comprises three rollers and the second roller unit comprises two rollers, a central roller of the first roller unit has on opposite sides thereof peripheral rollers which are spaced apart from each other, and first and second rollers of the second roller unit are placed, respectively, between the central and peripheral rollers of the first roller unit, and the first and second rollers of the second roller unit are spaced apart from each other and rotate the first roller unit when the second roller unit rotates.

30. A liquid-material application apparatus with a dual roller structure, comprising:

a body having a space for holding contents therein, with a first discharge port being formed on an upper portion of the body to discharge the contents;

a first roller support mounted on an upper portion of the body, and having on a lower surface thereof a second discharge port which communicates with the first discharge port;

a first roller unit rotatably mounted on an upper portion of the first roller support, and making contact with the contents which are discharged from the second discharge port;

a second roller support placed over the first roller support, and having a slit to permit a surface of the first roller unit to protrude therethrough; and a second roller unit rotatably coupled to the second roller support in such a way as to be in contact with the first roller unit which protrudes through the slit, wherein, when the second roller unit rotates, the first roller unit rotates while being in contact with the second roller unit such that the first roller unit transfers the contents discharged from the second discharge port to the second roller unit.

* * * * *